US007798348B2

(12) United States Patent
Sawyer

(10) Patent No.: US 7,798,348 B2
(45) Date of Patent: Sep. 21, 2010

(54) CHILD-RESISTANT CLOSURE

(75) Inventor: Duane Sawyer, York, PA (US)

(73) Assignee: Berry Plastics Corporation, Evansville, IN (US)

( * ) Notice: Subject to any disclaimer, the term of this patent is extended or adjusted under 35 U.S.C. 154(b) by 844 days.

(21) Appl. No.: 11/564,769

(22) Filed: Nov. 29, 2006

(65) Prior Publication Data

US 2007/0144996 A1 Jun. 28, 2007

Related U.S. Application Data

(60) Provisional application No. 60/743,006, filed on Dec. 2, 2005.

(51) Int. Cl.
*B65D 43/22* (2006.01)
*B65D 43/16* (2006.01)

(52) U.S. Cl. ..... 215/237; 215/245; 220/259.1; 220/283; 220/835; 222/556

(58) Field of Classification Search ..... 220/259.1, 220/281, 283, 835; 215/237, 235, 245; 222/556
See application file for complete search history.

(56) References Cited

U.S. PATENT DOCUMENTS

| | | | | |
|---|---|---|---|---|
| 3,850,326 | A | 11/1974 | Ryles | |
| 3,964,634 | A * | 6/1976 | Jasinski et al. | 220/281 |
| 4,022,352 | A | 5/1977 | Pehr | |
| 4,042,105 | A | 8/1977 | Taylor | |
| RE29,793 | E | 10/1978 | Pehr | |
| 4,244,495 | A | 1/1981 | Lorscheid et al. | |
| 4,444,326 | A | 4/1984 | Musel | |
| 4,629,081 | A | 12/1986 | McLaren | |
| 4,718,567 | A | 1/1988 | La Vange | |
| 4,752,014 | A * | 6/1988 | House et al. | 215/216 |
| 4,759,455 | A | 7/1988 | Wilson | |
| 4,782,964 | A | 11/1988 | Poore et al. | |
| 4,807,768 | A | 2/1989 | Gach | |
| 4,821,898 | A | 4/1989 | Smalley | |
| 4,838,441 | A | 6/1989 | Chernack | |
| 4,892,208 | A | 1/1990 | Sledge | |
| 4,940,167 | A * | 7/1990 | Fillmore et al. | 222/153.09 |
| 5,033,634 | A | 7/1991 | Batchelor et al. | |
| 5,092,493 | A | 3/1992 | Pehr | |
| 5,137,260 | A | 8/1992 | Pehr | |
| 5,180,072 | A | 1/1993 | Oehlert | |
| 5,207,657 | A | 5/1993 | Gibilisco | |
| 5,573,127 | A * | 11/1996 | Takahashi et al. | 215/237 |
| 5,765,705 | A | 6/1998 | Deubel | |
| 5,860,543 | A * | 1/1999 | Decelles | 215/209 |
| 5,996,859 | A * | 12/1999 | Beck | 222/556 |
| 6,170,710 | B1 * | 1/2001 | Suffa | 222/153.06 |
| 6,866,164 | B2 * | 3/2005 | Branson et al. | 222/153.14 |
| 7,510,095 | B2 * | 3/2009 | Comeau et al. | 215/321 |
| 7,611,024 | B2 * | 11/2009 | Yamanaka et al. | 215/237 |
| 2005/0133475 | A1 * | 6/2005 | Goto et al. | 215/237 |
| 2006/0016776 | A1 * | 1/2006 | Barre et al. | 215/237 |
| 2006/0249474 | A1 | 11/2006 | Sawyer et al. | |

* cited by examiner

*Primary Examiner*—Anthony Stashick
*Assistant Examiner*—Niki M Eloshway
(74) *Attorney, Agent, or Firm*—Barnes & Thornburg LLP

(57) ABSTRACT

A child-resistant closure is provided for connection to a container. The closure includes a base and a cap. The cap is secured to the base of the closure by use of a hinge.

23 Claims, 9 Drawing Sheets

CHILD-RESISTANT CLOSURE

This application claims priority under 35 U.S.C. §119(e) to U.S. Provisional Application Ser. No. 60/743,006, filed Dec. 2, 2005, which is expressly incorporated by reference herein.

BACKGROUND

The present disclosure relates to closures for mounting on the top of bottles or other containers, and in particular to a container closure including a "flip-top" cap. More particularly, the present disclosure relates to a child-resistant closure.

SUMMARY

According to the present disclosure, a child-resistant closure includes a body formed to include a product-dispensing spout and adapted to mount on a filler neck of a bottle or other container. The closure also includes a flip-top cap appended to a hinge that is arranged to support the flip-top cap for movement from a closed position on the body covering the product-dispensing spout to an opened position away from the body uncovering the product-dispensing spout.

In illustrative embodiments, the body includes an elastic web and an upstanding cap-retainer latch coupled to the elastic web for movement therewith during deformation of the elastic web. The cap-retainer latch is arranged to mate with a retention lug included in the flip-top cap to retain the flip-top cap in a closed position covering the product-dispensing spout formed in the body. To expose the product-dispensing spout, a user can squeeze the body to deform the elastic web. Such deformation of the elastic web causes the cap-retainer latch to separate from the retention lug so that the user can move the hinged flip-top cap to an "opened" position away from the body.

In illustrative embodiments, exterior surfaces of top and outer walls of the body cooperate to define an outwardly opening recessed alcove associated with the retention lug. The elastic web and a portion of the upstanding cap-retainer latch are located in the alcove.

It is within the scope of this disclosure to provide a first cap retainer including a first alcove, elastic web, and upstanding cap-retainer latch on one side of the body to interact with a first retention lug on one side of the flip-top cap. A second cap retainer including a second alcove, elastic web, and upstanding cap-retainer latch is also provided on an opposite side of the body to interact with a second retention lug provided on another side of the flip-top cap.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 11 is a sectional view of the closure of FIG. 1 (without the container) taken along line 11-11 of FIG. 1 showing the flip-top cap in a "closed" position on the body and showing a downwardly extending inner mount rim provided with internal threads and adapted to mate with a necked-in discharge outlet included in a container, as shown, for example, in FIG. 1;

FIG. 12 is a sectional view similar to FIG. 11 showing inward movement of the first cap-retainer latch (on the right) to disengage the first retention lug on the flip-top cap and inward movement of the second cap-retainer latch (on the left) and deformation of the top panel of the elastic web to disengage the second retention lug on the flip-top cap in response to opposing squeezing forces applied to an upper portion of the body by the thumb and forefinger which are used to release the flip-top cap from locked engagement to the body;

FIG. 13 is a sectional view similar to FIGS. 11 and 12 showing upward movement of the "released" flip-top cap away from the underlying body;

DETAILED DESCRIPTION

Figure 1:
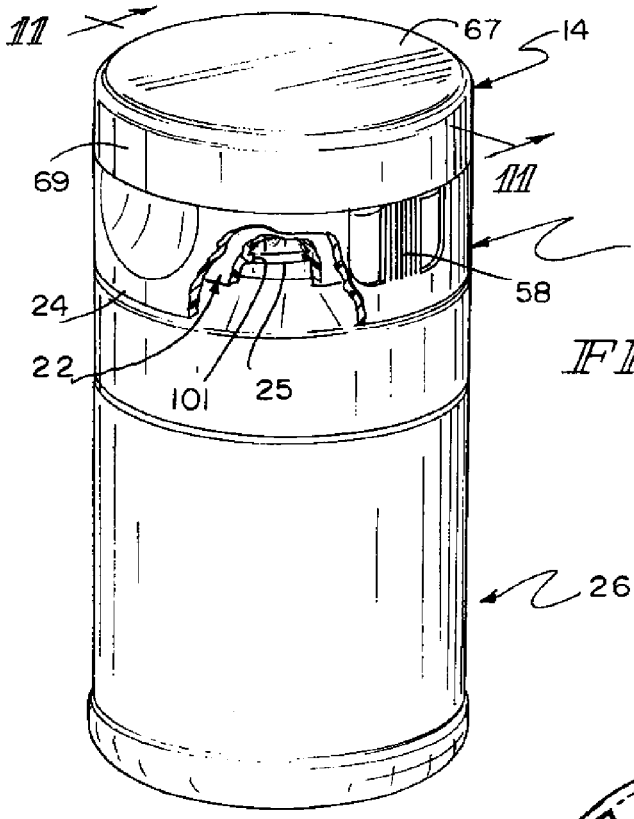
FIG. 1 is a perspective view of a child-resistant closure mounted on a "necked-in" discharge outlet included in the container to cover a mouth opening into an interior region formed in the container and formed to include a flip-top cap retained in a "closed" position on an underlying body coupled to the container with a portion of the closure body broken away to show how an interior mount rim included in the body (shown, for example, in FIG. 11) is coupled to the necked-in discharge outlet included in the container.
Figure 2:
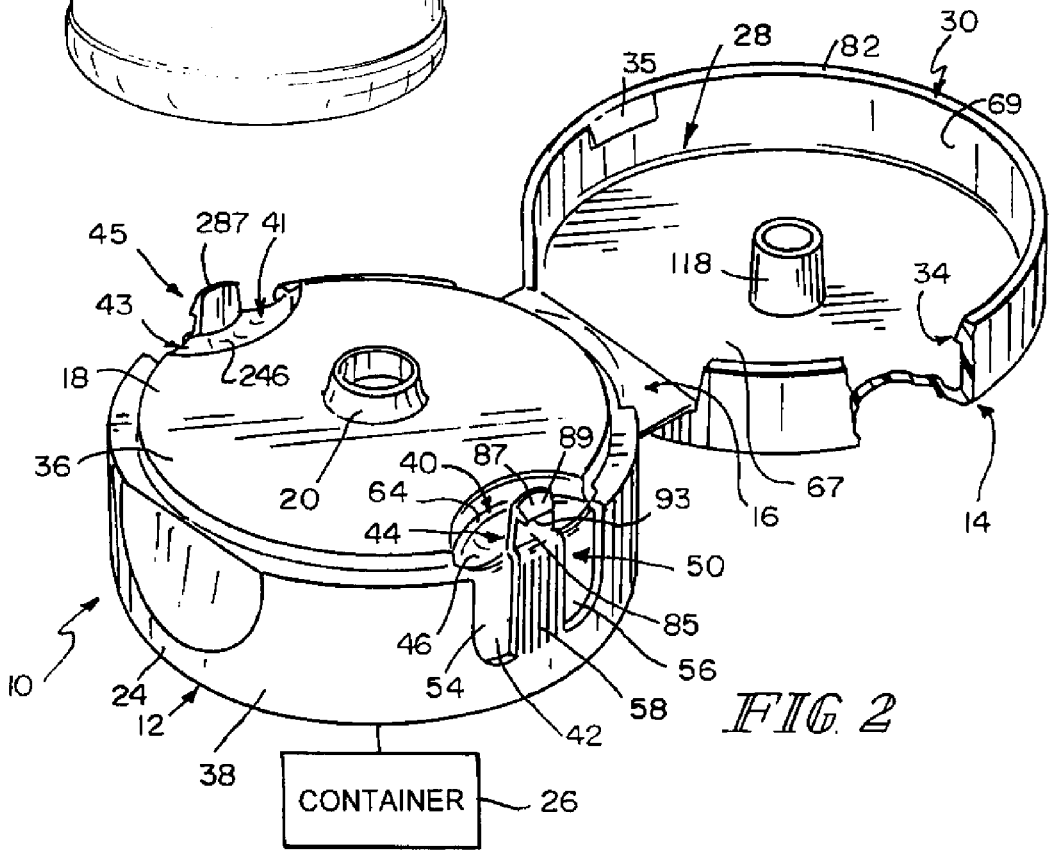
FIG. 2 is another perspective view of the closure of FIG. 1, with a portion broken away, after movement of the flip-top cap on a hinge relative to the body to an "opened" position exposing a product-dispensing spout formed in the body and showing the hinge interconnecting the body and the flip-top cap, a seal member formed on the underside of the flip-top cap for sealing the product-dispensing spout formed on the body to help retain the flip-top cap in a closed position on the body, two cap-retainer latches included in the body and arranged in spaced-apart relation to one another to locate the product-dispensing spout therebetween, and two retention lugs arranged in spaced-apart relation to one another on a circular side wall of the flip-top wherein the cap-retainer latches and the retention lugs cooperate to define "child-resistant" means for retaining the flip-top cap in a closed position on the closure body as suggested in FIG. 11.
Figure 3:
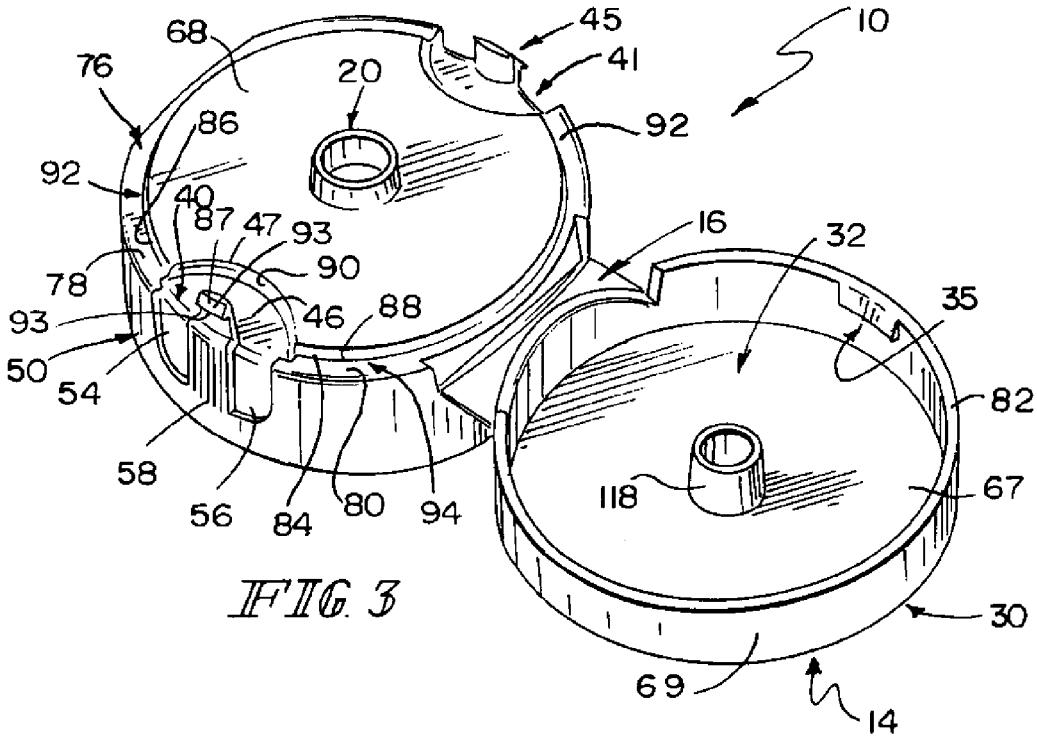
FIG. 3 is a second perspective view similar to FIG. 2 but taken from a different point of view showing the first and second cap-retainer latches included in alcoves formed in the closure body and one of the two retention lugs included in the flip-top cap.
Figure 4:
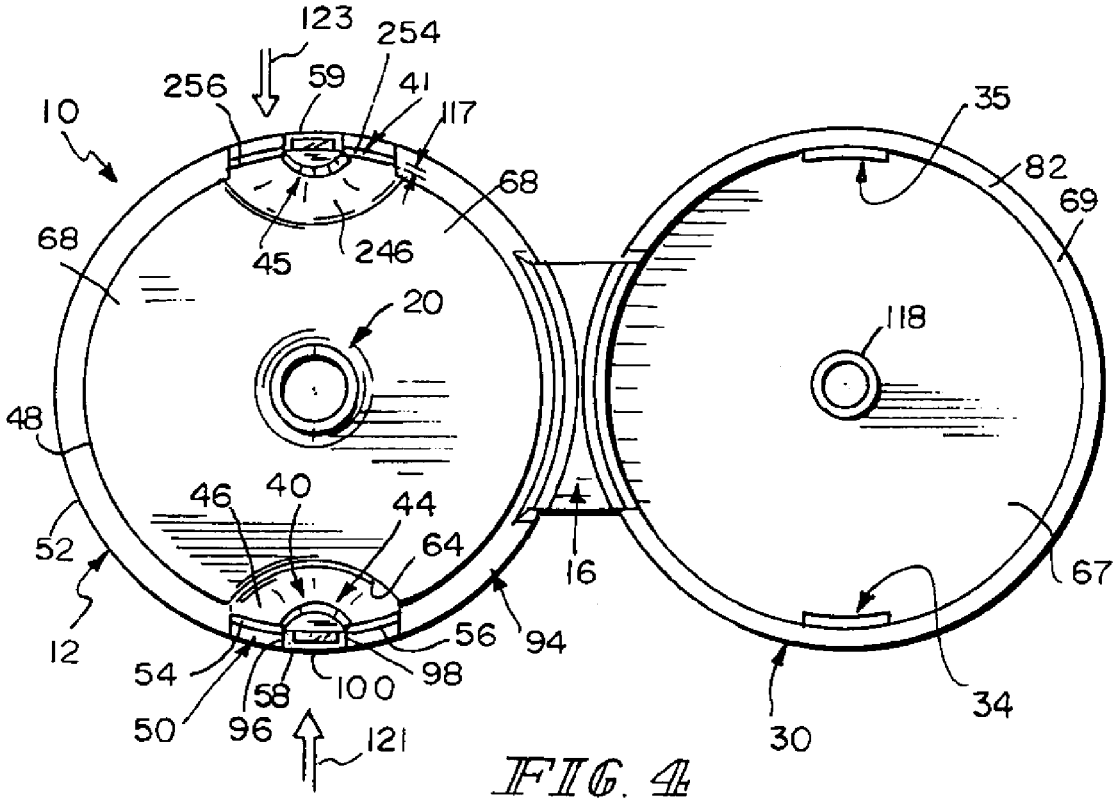
FIG. 4 is a top plan view of the "opened" closure of FIGS. 2 and 3 showing a first retention lug located at a "6 o'clock" position on the flip-top cap to mate with the first cap-retainer latch located in a first alcove at a similar "6 o'clock" position on the body when the flip-top cap is moved to a "closed" position, as shown in FIG. 11 and showing a second retention lug located at a "12 o'clock" position on the flip-top cap to mate with the second cap-retainer latch located in a second alcove at a similar "12 o'clock" position on the body when the flip-top cap is moved to the closed position shown in FIG. 11.

A child-resistant closure 10 includes a body 12 that is adapted to mate with a container 26, a flip-top cap 14, and a hinge 16 interconnecting body 12 and flip-top cap 14 as shown, in an opened position in FIGS. 2-4. Closure is adapted to be mounted on container 26 as suggested in FIGS. 1, 2, and 11. To open closure 10, body 12 can be squeezed by a user as suggested in FIG. 12 to deform first and second elastic webs 42, 43 and thereby cause movement of first and second cap-retainer latches 44, 45 in body 12 away from companion first and second retention lugs 34, 35 included in flip-top cap 14 as suggested in FIG. 12. Such latch/lug disengagement "releases" flip-top cap 12 so that it can be pivoted on hinge 16 away from body 12 by a user that is aware of the cap-opening procedure, as suggested in FIG. 13, to an "opened" position to expose a product-dispensing spout 20 formed in body 12. A child-resistant closure 210 in accordance with another embodiment of the disclosure is shown in FIGS. 15-19.

A child-resistant closure 10 includes a body 12, a flip-top cap 14, and a hinge 16 arranged to interconnect body 12 and flip-top cap 14, as shown, for example, in FIG. 2. Body 12 includes a top wall 18 formed to include a product-dispensing spout 20, an interior mount rim 22, and an outer wall 24. Interior mount rim 22 is appended to an underside 24 of top wall 18 and is adapted to mate with a discharge outlet 25 formed on a container 26, as shown, for example, in FIG. 1. Outer wall 24 of child-resistant closure 10 is cylinder-shaped in the illustrated embodiment and is appended to top wall 18. Outer wall 24 is arranged to extend downwardly away from top wall 18 and is adapted to cooperate with top wall 18 to form an interior region 28 for receiving interior mount rim 22 therein, as shown, for example, in FIG. 11.

Flip-top cap 14 includes a movable lid 30 formed to include an interior chamber 32 and a first retention lug 34 coupled to lid 30 to move therewith, as shown, for example, in FIG. 2. Exterior surfaces 36, 38 of top and outer walls 18, 24 cooperate to define an outwardly opening recessed first alcove 40 associated with first retention lug 34. Lid 15 includes a top wall 67 and an annular side wall 69 appended to top wall 67. Side wall 69 includes a lower edge 82 that is adapted to be positioned to lie adjacent to Side wall 69 includes a lower edge 82 that is adapted to be positioned to lie adjacent to top wall 18 of body 12 when flip-top cap 14 is in the closed position. First retention lug 34 is formed on annular side wall 69 of lid 30 and is positioned within interior chamber 32.

Hinge 16 is coupled to body 12 and to lid 30 to support flip-top cap 14. Hinge 16 allows for movement of flip-top cap 14 relative to body 12 from a closed position on body 12 covering product-dispensing spout 20, as shown, for example, in FIGS. 1 and 11, to an opened position away from body 12 uncovering product-dispensing spout 20, as shown, for example, in FIG. 2. Hinge 16 is a "living hinge" and cooperates with body 12 and flip-top cap 14 to form a monolithic element.

Body 12 further includes an elastic web 42 located in first alcove 40 and an upstanding first cap-retainer latch 44 coupled to elastic web 42 for movement therewith during deformation of elastic web 42, as shown, for example, in FIGS. 2-5. First cap-retainer latch 44 is a finger-like projection that is arranged to mate with first retention lug 34 in interior chamber 32 formed in lid 30 to retain flip-top cap 14 in the closed position on body 12 in response to movement of flip-top cap 14 to the closed position. First cap-retainer latch 44 is also arranged to separate from first retention lug 34 in response to deformation of elastic web 42 relative to top and outer walls 18, 24 of body 12 to allow movement of flip-top cap 14 away from body 12 toward the opened position.

Figure 5:
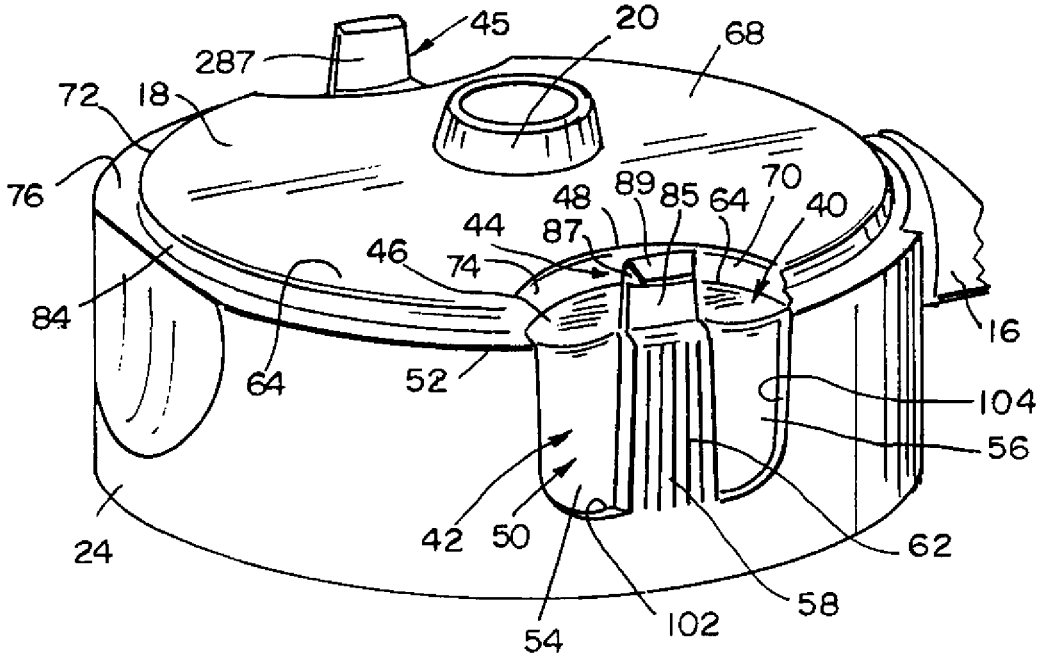
FIG. 5 is an enlarged perspective view of the body of FIGS. 2-4 showing the first cap-retainer latch coupled to the first elastic web and located in the first alcove formed in the body.
Figure 6:
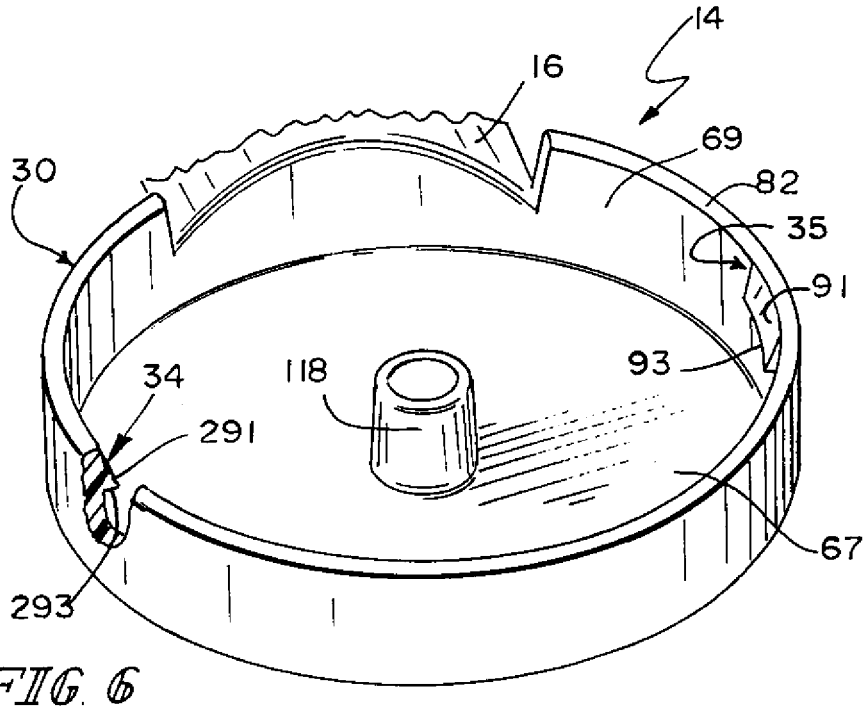
FIG. 6 is an enlarged perspective view of the flip-top cap of FIGS. 2-4 showing the first retention lug (on the left and visible "in section" through the "broken-away" portion of the side wall of the flip-top cap) and the second retention lug (on the right)
Figure 7:
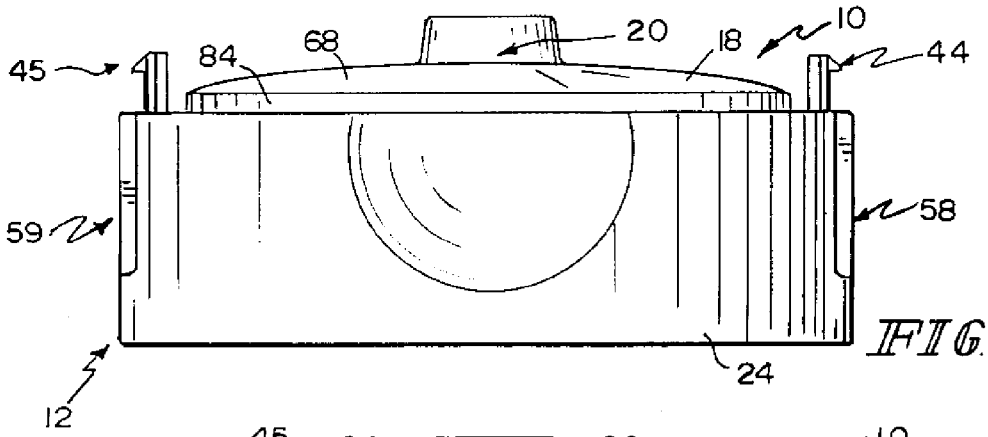
FIG. 7 is a front elevation view of the "opened" closure of FIG. 2.
Figure 8:
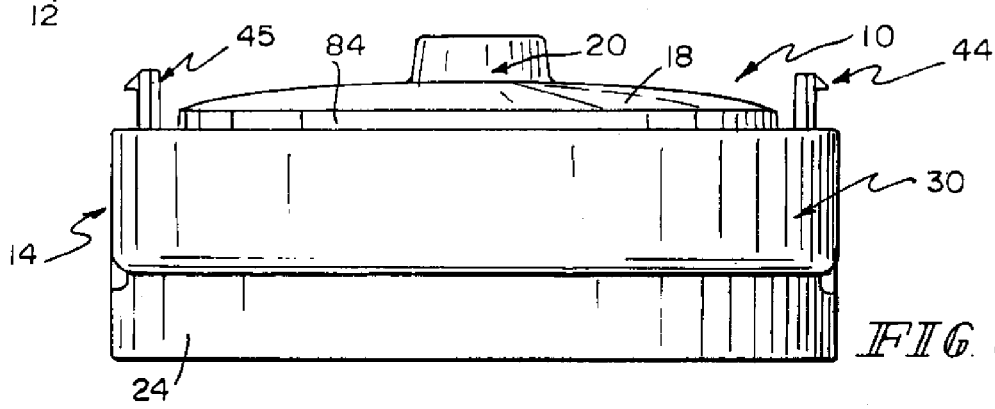
FIG. 8 is a rear elevation view of the opened closure of FIG. 7.

Elastic web 42 of body 12 includes a deformable top panel 46 coupled to a section of a perimeter edge 48 of the top wall 18 and to first cap-retainer latch 44, as shown, for example, in FIG. 5. Top wall 18 has a first thickness 113 and deformable top panel 46 has a second thickness 115 that is "thinner" than first thickness 113, as shown, for example, in FIG. 11.

Elastic web 42 also includes a deformable side panel 50 coupled to a section of a perimeter edge 52 of outer wall 24 of body 12 and to deformable top panel 46 and to first cap-retainer latch 44, as shown, for example, in FIG. 5. Deformable side panel 50 includes a first panel section 54 coupled to deformable top panel 46, a second panel section 56 located in spaced-apart relation to first panel section 54 and coupled to deformable top panel 46, and a first latch-release pad 58 arranged to interconnect first and second panel sections 54, 56 and extend upwardly in a vertical direction toward first cap-retainer latch 44. Each of first and second panel sections 54, 56 of deformable side panel 50 have a thickness 117 that is thinner than first thickness 113, as shown, for example, in FIG. 4. Elastic web 35 is molded with top and outer wall 18, 24 to form a monolithic element. Since elastic web 35 is deformable, it is unnecessary to provide relief in the form of holes or slots in outer wall 24, which could otherwise allow debris to enter into interior region 28.

Figure 11:
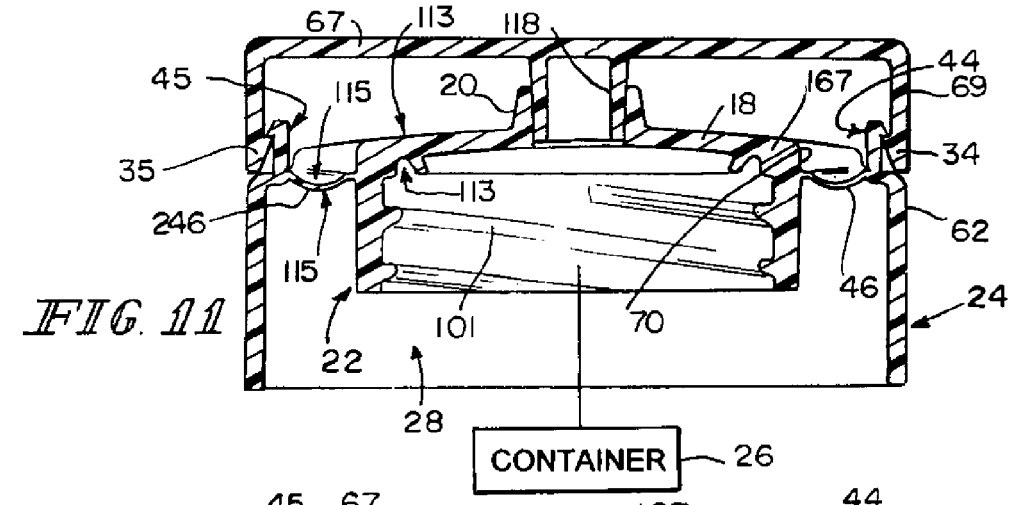
FIGS. 11-13 show a flip-top cap opening sequence for the closure shown in FIGS. 1-10.
Figure 12:
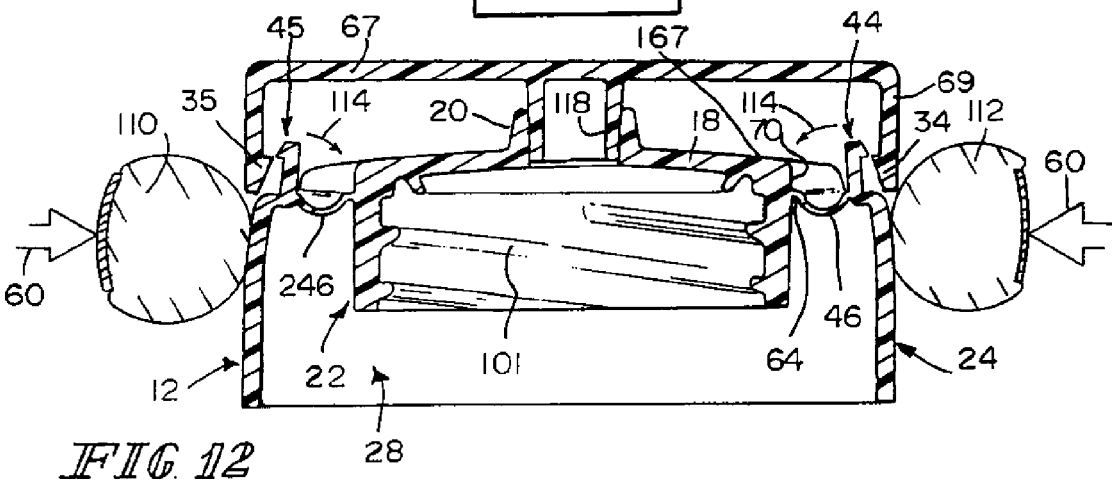

First latch-release pad 58 of elastic web 42 is configured to provide means for deforming each of first and second panel sections 54, 56 of deformable side panel 50 and deformable top panel 46 upon exposure to an inward pushing force 60 applied by a user's thumb 110 to an exterior portion 62 of first latch-release pad 58, as shown, for example, in FIGS. 5 and 12. This inward pushing force 60 causes movement of first cap-retainer latch 44 relative to top wall 18 of body 12 to disengage first retention lug 34 included in flip-top cap 14 when flip-top cap 14 is in the closed position so that flip-top cap 14 is free to be moved by the user away from the closed position toward the opened position, as shown, for example, in FIG. 12. Deformable top panel 46 includes an inner edge 64 that is coupled to a junction 167 between the top wall 18 and interior mount rim 22, as shown, for example, in FIGS. 5 and 11.

In an illustrative embodiment, interior mount rim 22 includes threads 101 to permit child-resistant closure 10 to be secured to container 36 as shown, for example, in FIG. 11.

While a threaded arrangement is shown, it is within the scope of this disclosure to provide any suitable attachment means to secure child-resistant closure 10 to container 36. For example, a "snap-connection" attachment mount system 200 is provided in child-resistant closure 210 as suggested in FIGS. 18 and 19. Container 226 is adapted to mate with system 200 as suggested in FIG. 19.

In illustrative embodiments, child-resistant closure 10 is configured to be coupled to a discharge outlet 25 of a container 36 and formed to include a body 12 and a flip-top cap 14 appended to a hinge 16 to support flip-top cap 14 for movement from a position away from body 12, as shown, for example, in FIG. 2. In illustrative embodiments, body 12 includes a first cap-retainer latch 44 that is coupled to a deformable first elastic web 42 provided in a first alcove 40 of body 12. Body 12 also includes a second cap-retainer latch 45 that is coupled to a deformable second elastic web 43 provided in a second alcove 41 of body 12. First and second cap-retainer latches 44, 45 are adapted to mate with companion first and second retention lugs 34, 35 formed in flip-top cap 14 to retain flip-top cap 14 in the closed position on body 12 as a security measure until a consumer elects to move flip-top cap 14 relative to body 12 to assume the opened position.

In illustrative embodiments, body 12 is formed to include first and second elastic webs 42, 43 located, respectively, in first and second alcoves 40, 41 formed in an outer wall of body 12. Body 12 is also formed to include first and second cap-retainer latches 44, 45 that are coupled, respectively, to first and second elastic webs 42, 43 for movement therewith. First and second cap-retainer latches are arranged to mate with first and second retention lugs 34, 35 in flip-top cap 14 upon movement of flip-top cap 14 to the closed position on body 12. Flip-top cap 14 is retained in the closed position on body 12 upon mating engagement of cap-retainer latches 44, 45 and retention lugs 34, 35.

To release the mating engagement of first and second cap retainer latches 44, 45 from companion first and second retention lugs 34, 35, an operator squeezes together first and second latch-release pads 58, 59 included in elastic webs 42, 43 to deform elastic webs 42, 43 and cause first and second cap-retainer latches 44, 45 to move inwardly to disengage first and second retention lugs 34, 35, as shown, for example, in FIG. 12. When flip-top cap 14 is later returned to the closed position, first and second retention lugs 34, 35 will "cam" and move first and second cap-retainer latches 44, 45 inwardly to deform elastic webs 42, 43 temporarily so that first and second cap-retainer latches 44, 45 snap into mating engagement with first and second retention lugs 34, 35, as shown, for example, in FIG. 14.

In illustrative embodiments, first and second elastic webs each include a deformable top panel 46, 246 and a deformable side panel 50, 250. Each deformable side panel 50, 250 is formed to include first and second panel sections interconnected by a latch release pad. Each of first and second elastic webs 42, 43 is configured to deform elastically when the release pads are depressed inwardly to release flip-top cap 14 from the closed position. Elastic webs 42, 43 are also configured to deform elastically during mating engagement of each companion pair of cap-retainer latches and retention lugs to allow limited movement of cap-retainer latches 44, 45 relative to the outer annular side wall of body 12.

Perimeter edge 48 of top wall 18 adjacent deformable top panel 46 is C-shaped in the illustrated embodiment. Top wall 18 includes a horizontal plate 68 formed to include product-dispensing spout 20 and a C-shaped vertical plate 70 coupled to an outer edge 72 of horizontal plate 68, as shown, for example, in FIG. 5. C-shaped vertical plate 70 is formed to include a concave exterior surface 74 arranged to face toward and lie in spaced-apart relation to upstanding first cap-retainer latch 44. A product-dispensing spout 220 provided in child-resistant closure 200 has a relatively larger diameter than spout 20 as suggested in FIGS. 18 and 19.

Top wall 18 includes an outer rim 76 including a horizontal first arcuate section 78 and a horizontal second arcuate section 80 arranged to lie in spaced-apart relation to the horizontal first arcuate section 78, as shown, for example, in FIG. 3. A portion 47 of deformable top panel 46 is arranged to interconnect horizontal first and second arcuate sections 78, 80. Lid 30 includes a lower edge 82 arranged to face toward and lie in confronting relation to horizontal first and second arcuate sections 78, 80 of outer rim 76 upon movement of flip-top cap 14 to the closed position, as suggested in FIGS. 2 and 3. Upstanding first cap-retainer latch 44 is arranged to mate with deformable top panel 46 midway between horizontal first and second arcuate sections 78, 80, as shown, for example, in FIG. 3.

Top wall 18 includes horizontal plate 68 formed to include product-dispensing spout 20 and a raised edge 84 arranged to interconnect outer rim 76 and horizontal plate 68, as shown, for example, in FIG. 5. Raised edge 84 is formed to include a convex first vertical exterior surface 86, a convex second vertical exterior surface 88, and a concave vertical exterior surface 90, as shown, for example, in FIG. 3. Convex first vertical exterior surface 86 is coupled to horizontal first arcuate section 78 to define a first exterior lid-receiver channel 92 in cooperation therewith. Convex second vertical exterior surface 88 is coupled to horizontal second arcuate section 80 to define a second exterior lid-receiver channel 94 in cooperation therewith. Concave vertical exterior surface 90 is arranged to interconnect convex first and second vertical surfaces 86, 88 and to interconnect horizontal plate 68 and deformable top panel 46. First and second exterior lid-receiver channels 92, 94 are sized to receive lower edge 82 of lid 30 therein upon movement of flip-top cap 14 to the closed position to locate first retention lug 34 in first alcove 40 above deformable top panel 46 and in engagement with first cap-retainer latch 44, as suggested in FIG. 3.

In the illustrated embodiment, first latch-release pad 58 includes a first radially outwardly extending side wall 96 coupled to first panel section 54, a second radially outwardly extending side wall 98 coupled to second panel section 56, and a circumferentially extending exterior wall 100 interconnecting first and second radially outwardly extending side walls 96, 98 and interconnecting outer wall 24 and first cap-retainer latch 44, as shown, for example, in FIG. 4. Perimeter edge 52 of outer wall 24 includes a first J-shaped border edge 102 coupled to first panel section 54 and a second J-shaped border edge 104 coupled to second panel section 56, as shown, for example, in FIG. 5.

Exterior surfaces 36, 38 of top and outer walls 18, 24 cooperate to define an outwardly opening recessed second alcove 41 associated with a second retention lug 35 coupled to lid 30 to move therewith, as shown, for example, in FIG. 2. Body 12 further includes a second elastic web 43 located in second alcove 41 and an upstanding second cap-retainer latch 45 coupled to second elastic web 43 for movement therewith during deformation of second elastic web 43. Upstanding second cap-retainer latch 45 is arranged to mate with second retention lug 35 in interior chamber 32 formed in lid 30 to retain flip-top cap 14 in the closed position on body 12 in response to movement of flip-top cap 14 to the closed position and to separate from second retention lug 35 in response to deformation of second elastic web 43 relative to top and outer walls 18, 24 of body 12 to allow movement of flip-top cap 14 away from body 12 toward the opened position.

Figure 9:
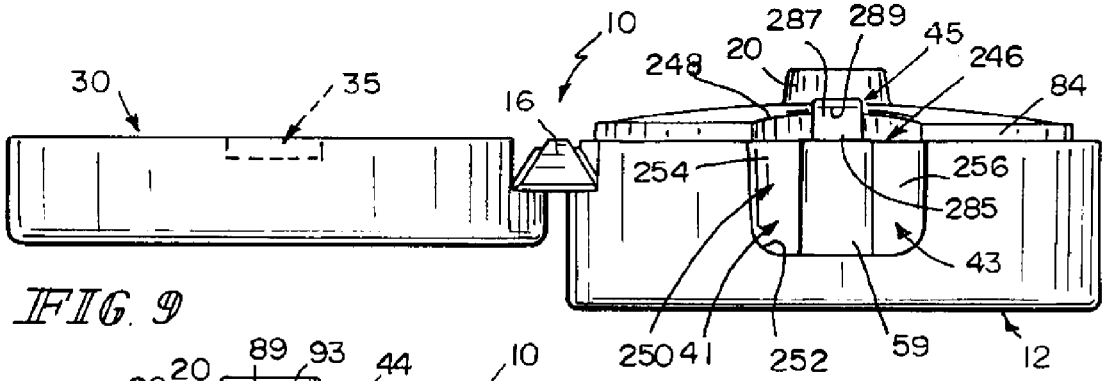
FIG. 9 is a left-side elevation view of the opened closure of FIG. 7 showing the second cap-retainer latch coupled to the second elastic web located in the second alcove and showing the second retention lug (in phantom) on the flip-top cap.
Figure 10:
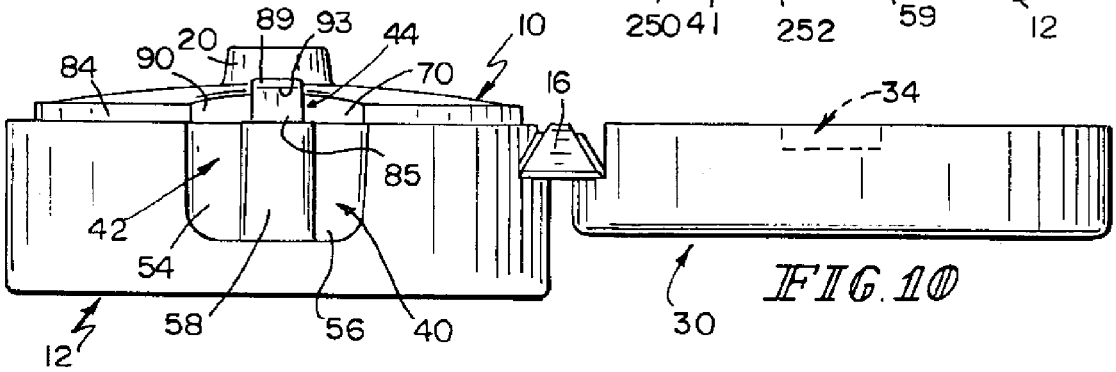
FIG. 10 is a right-side elevation view of the opened closure of FIG. 7 showing the first cap-retainer latch coupled to the first elastic web located in the first alcove and showing the first retention lug (in phantom) on the flip-top cap.

Second elastic web 43 includes a deformable top panel 246 coupled to a section of a perimeter edge 248 of the top wall 18 and to the second cap-retainer latch 45, as shown, for example, in FIG. 9. Top wall 18 of body 12 has a thicker wall thickness than the wall thickness of deformable top panel 246.

Second elastic web 43 also includes a deformable side panel 250 coupled to a section of a perimeter edge 252 of outer wall 24 of body 12 and to deformable top panel 246 and to second cap-retainer latch 45, as shown, for example, in FIG. 9. Deformable side panel 250 of second elastic web 43 includes a first panel section 254 coupled to deformable top panel 246, a second panel section 256 located in spaced-apart relation to first panel section 254 and coupled to deformable top panel 246, and a first latch-release pad 59. Second cap-retainer latch includes a hook 287 having a vertical wall 285 and a ramped surface 289 that engages second retention lug 35 when flip-top cap 14 is in a closed position. Each of first and second panel sections 254, 256 of deformable side panel 250 have a thinner wall thickness than the wall thickness of outer wall 24.

First cap-retainer latch 44 includes a vertical wall 85 and a hook 87 that extends outwardly from vertical wall 85 as shown, for example, in FIG. 2. Hook 87 includes a ramped surface 89 that is adapted to engage first retention lug 34, when flip-top cap 14 is moved to the closed position. Hook 87 also includes flat surface 93 that extends outwardly from vertical wall 85. First retention lug 34 includes a ramped surface 91 that is adapted to engage ramped surface 89 of hook 87 when flip-top cap 14 is moved to the closed position. First retention lug 34 also includes a release-blocking face 93 that engages flat surface 93 of hook 87 when flip-top cap 14 is in the closed position. Second retention lug 35 includes a ramped surface 291 and a release block face 293, which engage hook 287 of second cap-retainer latch 45. First retention lug 34 is located at a "6 o'clock" position 121 on flip-top cap 14 and is adapted to mate with first cap-retainer latch 44 at a similar "6 o'clock" position on body 12 when flip-top cap 14 is in the closed position as shown for example in FIG. 4. Second retention lug 35 is located at a "12 o'clock" position 123 on flip-top cap 14 at a similar "12 o'clock" position 123 on body 12 when flip-top cap is in the closed position.

Figure 13:
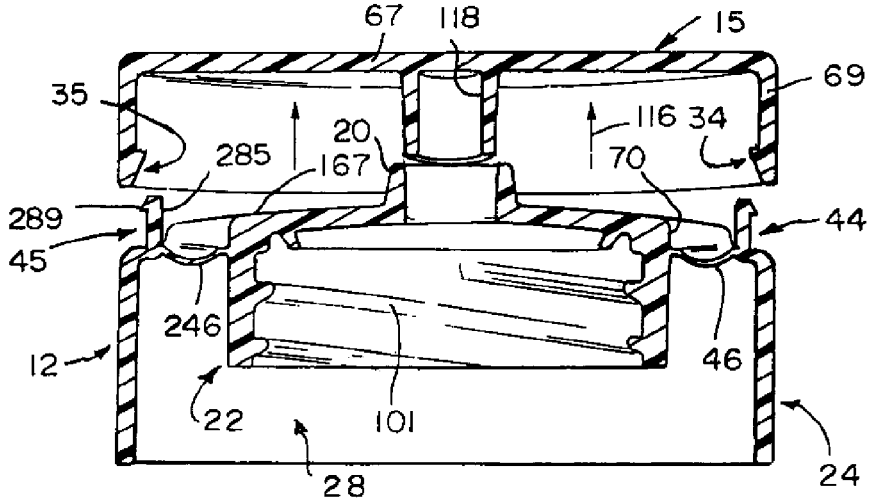

The procedure for opening flip-top cap 14 of child-resistant closure 10 is shown in an illustrative sequence of FIGS. 11-13. Flip-top cap 14 is illustrated in FIG. 1 in a closed position. With flip-top cap 14 in the closed position, first and second cap-retainer latches 44, 45 of body 12 are engaged with first and second retention lugs 34, 35. Also seal member 118 of lid 30 is positioned within product-dispensing spout 20 and deformable panels 46, 50 of first and second alcoves 40, 41 are in a relaxed position. To open flip-top cap 14 of child-resistant closure 10 from body 12, a user depresses first and second latch-release pads 58, 59 of first and second cap-retainer latches 44, 45 with a thumb 110 and a forefinger 112 in direction 60, as shown, for example, in FIG. 12.

Depressing first and second latch-release pads 58, 59 causes deformation of elastic webs 42, 43 and causes first and second cap-retainer latches 44, 45 to move inwardly in direction 114, to disengage first and second cap-retainer latches 44, 45 from first and second latch-retention lugs 34, 35. Once first and second cap-retainer latches 44, 45 are clear of first and second latch-retention lugs 34, 35, flip-top cap 14 can be pivoted about hinge 16 in direction 116 to the opened position, as shown, for example, in FIG. 13. When latch-retention lugs 34, 35 are clear of first and second cap-retainer latches 44, 45, release pads 58, 59 can be released, to allow cap-retainer latches 44, 45 to return to a "relaxed" position.

Figure 14:
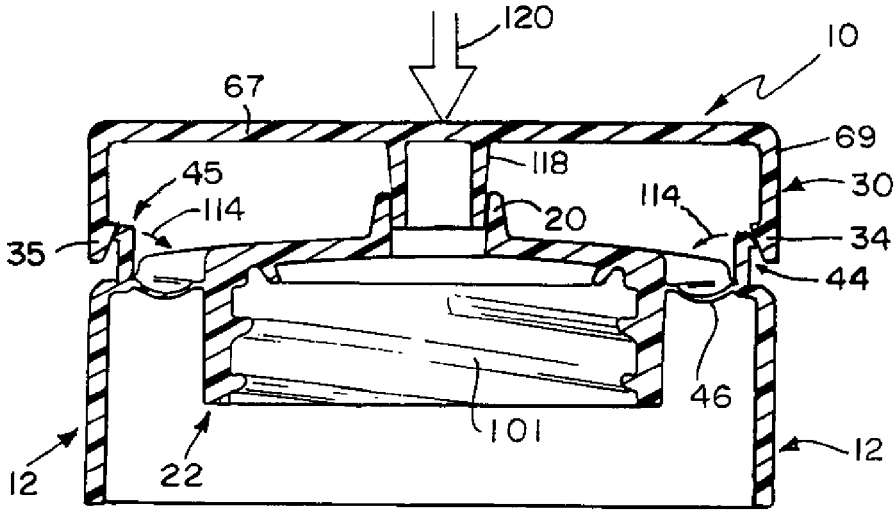
FIG. 14 is a sectional view similar to FIGS. 11-13 showing downward movement of the flip-top cap toward a closed position on the body to re-engage the first cap-retainer latch to the first retention lug and to re-engage the second cap-retainer latch to the second retention lug.
Figure 15:
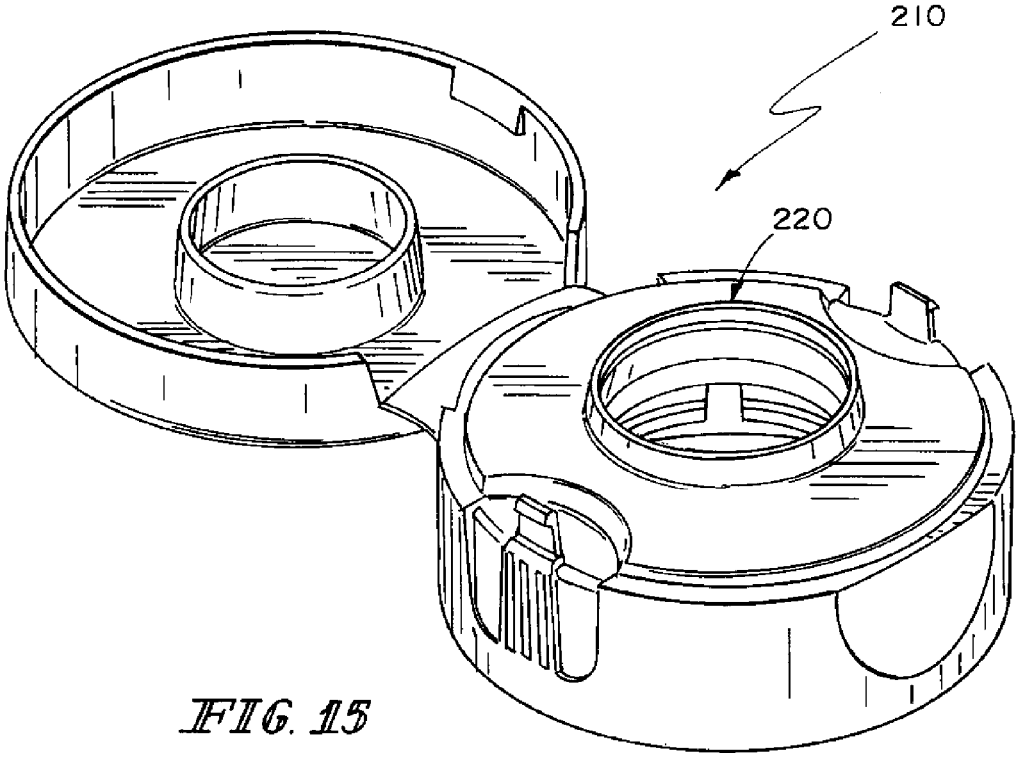
FIGS. 15-18 show a child-resistant closure in accordance with another embodiment of the disclosure in an opened position wherein the body is formed to include a large-diameter product-dispensing spout and a body formed to include a snap-connection attachment mount system adapted to mate with a container.
Figure 16:
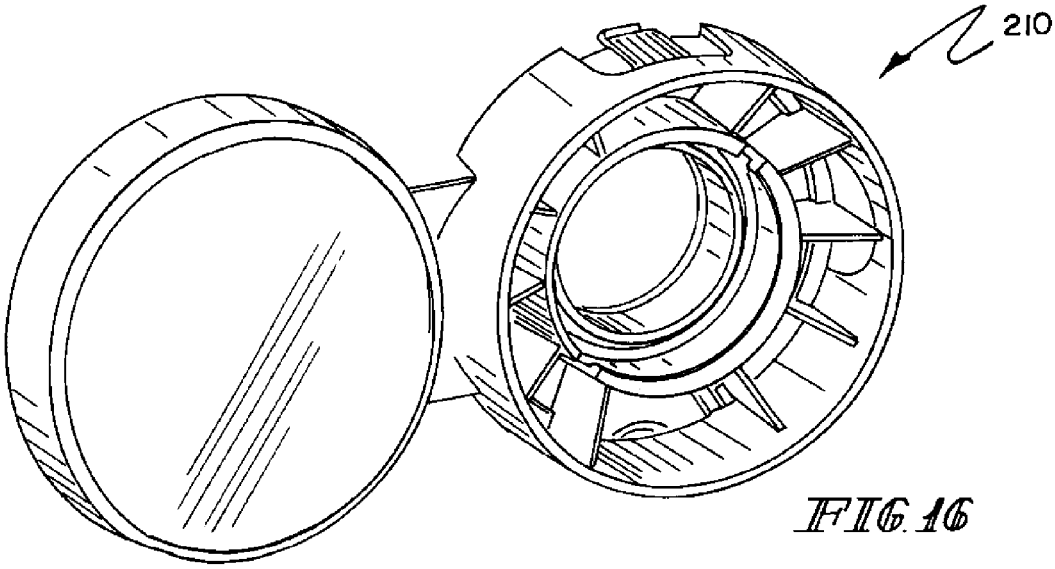
Figure 17:
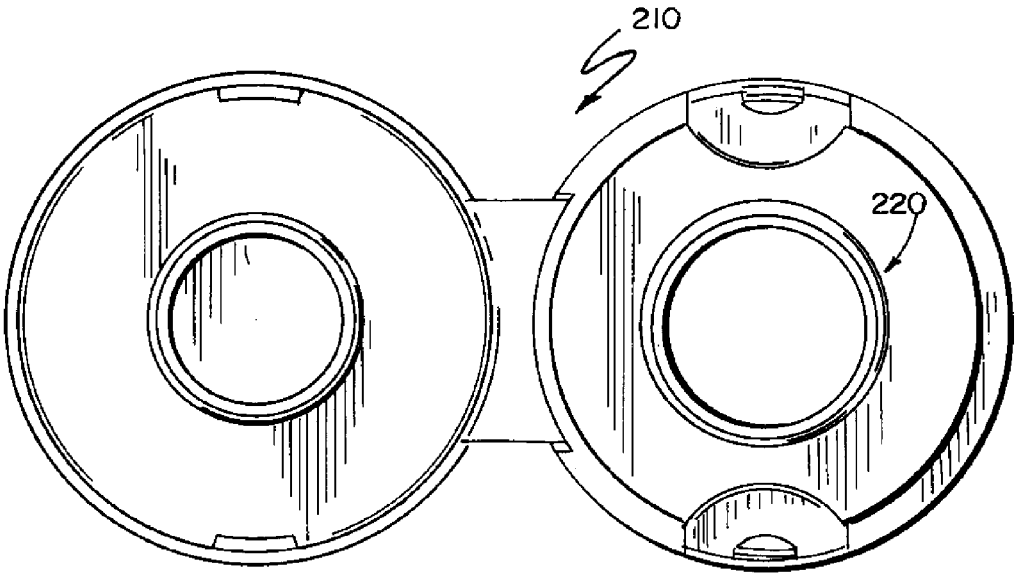
Figure 18:
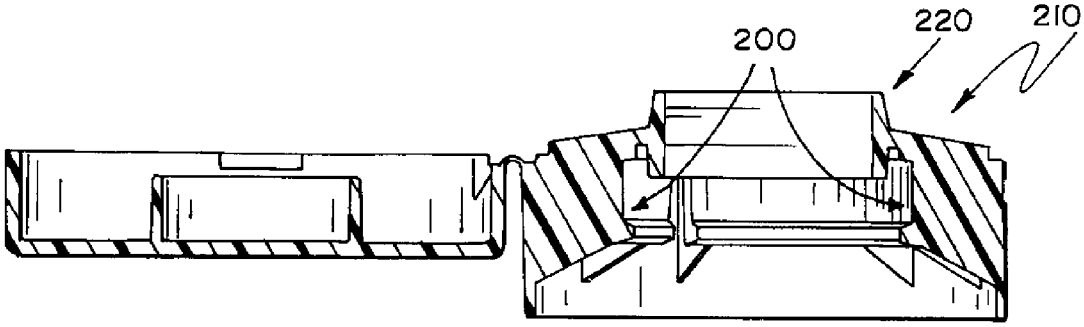
Figure 19:
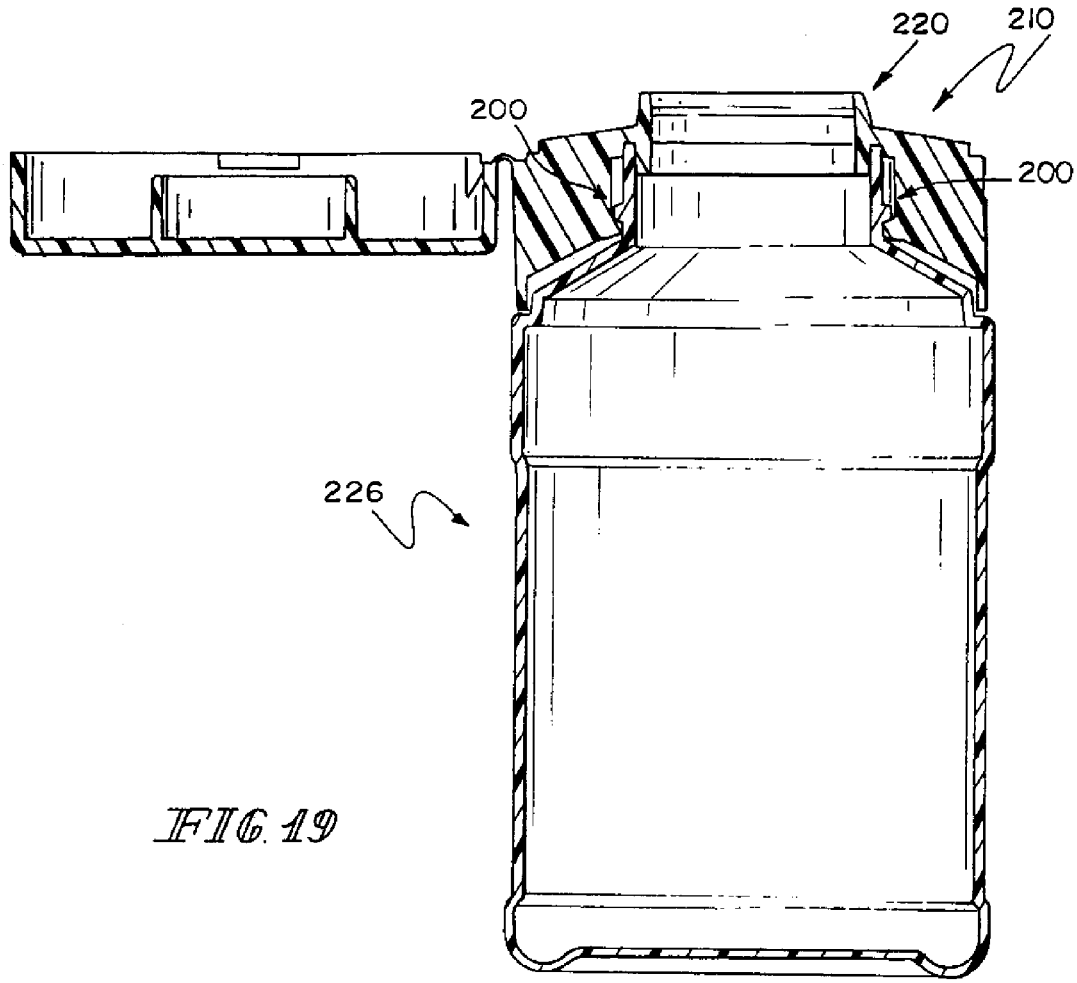
FIG. 19 is a sectional view of the child-resistant closure of FIGS. 15-18 mounted on an underlying container.

Once a desired amount of liquid (or other product) is dispensed through product-dispensing spout 20, flip-top cap 14 can be closed by pivoting flip-top cap 14 about hinge 16 in direction 120, as shown, for example, in FIG. 14. Moving flip-top cap 14 in direction 120 causes first and second latch-retention lugs 34, 35 to engage first and second cap-retainer latches 44, 45 to force latches 44, 45 inwardly in direction 114. Inward movement of first and second cap-retainer latches 44, 45 causes temporary deformation of elastic webs 42, 43 and, for example, deformable top and side panels 46, 50. Inward movement of cap-retainer latches 44, 45 allows first and second latch-retention lugs 34, 35 to engage first and second cap-retainer latches 44, 45 to secure cap 14 in a closed position. When cap 14 is in the closed position, seal member 118 is positioned within product-dispensing spout 20. In the closed position, flip-top cap 14 cannot be reopened unless first and second latch-release pads 58, 59 are depressed by the user.

The invention claimed is:

1. A child-resistant closure comprising a body including a top wall formed to include a product-dispensing spout, an interior mount rim appended to an underside of the top wall and adapted to mate with a discharge outlet formed on a container, and an outer wall appended to the top wall and arranged to extend downwardly away from the top wall and to cooperate with the top wall to form an interior region receiving the interior mount rim therein, a flip-top cap including a movable lid formed to include an interior chamber and a first retention lug coupled to the lid to move therewith, a hinge coupled to the body and to the lid to support the flip-top cap for movement relative to the body from a closed position on the body covering the product-dispensing spout to an opened position away from the body uncovering the product-dispensing spout, wherein exterior surfaces of the top and outer walls cooperate to define an outwardly opening recessed first alcove associated with the first retention lug, the body further includes an elastic web located in the first alcove and an upstanding first cap-retainer latch coupled to the elastic web for movement therewith during deformation of the elastic web, and the first cap-retainer latch is arranged to mate with the first retention lug in the interior chamber formed in the lid to retain the flip-top cap in the closed position on the body in response to movement of the flip-top cap to the closed position and to separate from the first retention lug in response to deformation of the elastic web relative to the top and outer walls of the body to allow movement of the flip-top cap away from the body toward the opened position, and wherein the elastic web includes a deformable top panel coupled to a section of a perimeter edge of the top wall and to the first cap-retainer latch.

2. The closure of claim 1, wherein the top wall has a first thickness and the deformable top panel has a second thickness that is thinner than the first thickness.

3. The closure of claim 2, wherein the deformable top panel has an inner edge that is coupled to a junction between the top wall and the interior mount rim.

4. The closure of claim 1, wherein the section of the perimeter edge of the top wall is C-shaped and the top wall includes a horizontal plate formed to include the product-dispensing spout and a C-shaped vertical plate coupled to an outer edge of the horizontal plate and formed to include a concave exterior surface arranged to face toward and lie in spaced-apart relation to the upstanding first cap-retainer latch.

5. The closure of claim 1, wherein the top wall includes an outer rim including a horizontal first arcuate section and a horizontal second arcuate section arranged to lie in spaced-apart relation to the horizontal first arcuate section, a portion of the deformable top panel is arranged to interconnect the horizontal first and second arcuate sections, and the lid includes a lower edge arranged to face toward and lie in confronting relation to the horizontal first and second arcuate sections of the outer rim upon movement of the flip-top cap to the closed position.

6. The closure of claim 5, wherein the upstanding first cap-retainer latch is arranged to mate with the deformable top panel at a location that is about midway between the horizontal first and second arcuate sections.

7. The closure of claim 5, wherein the top wall further includes a horizontal plate formed to include the product-dispensing spout and a raised edge arranged to interconnect the outer rim and the horizontal plate, the raised edge is formed to include a convex first vertical exterior surface coupled to the horizontal first arcuate section to define a first exterior lid-receiver channel in cooperation therewith, a convex second vertical exterior surface coupled to the horizontal second arcuate section to define a second exterior lid-receiver channel in cooperation therewith, and a concave vertical exterior surface arranged to interconnect the convex first and second vertical surfaces and to interconnect the horizontal plate and the deformable top panel, and the first and second exterior lid-receiver channels are sized to receive a lower edge of the lid therein upon movement of the flip-top cap to the closed position to locate the first retention lug in the first alcove above the deformable top panel and in engagement with the first cap-retainer latch.9. The closure of claim 2, wherein the elastic web further includes a deformable side panel coupled to a section of a perimeter edge of the outer wall of the body and to the deformable top panel and to the first cap-retainer latch.

8. The closure of claim 1, wherein the elastic web further includes a deformable side panel coupled to a section of a perimeter edge of the outer wall of the body and to the deformable top panel and to the first cap-retainer latch.

9. The closure of claim 8, wherein the deformable side panel includes a first panel section coupled to the deformable top panel, a second panel section located in spaced-apart relation to the first panel section and coupled to the deformable top panel, and a first latch-release pad arranged to interconnect the first and second panel sections and extend upwardly in a vertical direction toward the first cap-retainer latch.

10. The closure of claim 9, wherein the top wall has a first thickness and each of the first and second panel sections of the deformable side panel and the deformable top panel has a thickness that is thinner than the first thickness.

11. The closure of claim 9, wherein the outer wall has a first thickness and each of the first and second panel sections of the deformable side panel and the deformable top panel has a thickness that is thinner than the first thickness.

12. The closure of claim 9, wherein the first latch-release pad is configured to provide means for deforming each of the first and second panel sections of the deformable side panel and the deformable top panel upon exposure to an inward pushing force applied by a user to an exterior portion of the first latch-release pad to cause movement of the first cap-retainer latch relative to the top wall of the body to disengage the first retention lug included in the flip-top cap when the flip-top cap is in the closed position so that the flip-top cap is free to be moved by the user away from the closed position toward the opened position.

13. The closure of claim 1, wherein the elastic web includes a deformable side panel coupled to a section of a perimeter edge of the outer wall of the body and to the first cap-retainer latch.

14. The closure of claim 13, wherein the outer wall has a first thickness and the first panel section has a thickness that is thinner than the first thickness and lies in the outwardly opening recessed first alcove in offset relation to an outwardly facing exterior surface of the outer wall.

15. The closure of claim 13, wherein the deformable side panel includes a first panel section coupled to the outer wall, a second panel section located in spaced-apart relation to the first panel section and coupled to the outer wall, and a first latch-release pad arranged to interconnect the first and second panel sections and extend upwardly in a vertical direction toward the first cap-retainer latch.

16. The closure of claim 15, wherein the outer wall has a first thickness and each of the first and second panel sections of the deformable side panel and the deformable top panel has a thickness that is thinner than the first thickness.

17. The closure of claim 15, wherein the first latch-release pad is configured to provide means for deforming each of the first and second panel sections of the deformable side panel upon exposure to an inward pushing force applied by a user to an exterior portion of the first latch-release pad to cause movement of the first cap-retainer latch relative to the top wall of the body to disengage the first retention lug included in the flip-top cap when the flip-top cap is in the closed position so that the flip-top cap is free to be moved by the user away from the closed position toward the opened position.

18. The closure of claim 1, wherein the exterior surfaces of the top and outer walls cooperate to define an outwardly opening recessed second alcove associated with a second retention lug coupled to the lid to move therewith, the body further includes a second elastic web located in the second alcove and an upstanding second cap-retainer latch coupled to the second elastic web for movement therewith during deformation of the second elastic web, and the upstanding second cap-retainer latch is arranged to mate with the second retention lug in the interior chamber formed in the lid to retain the flip-top cap in the closed position on the body in response to movement of the flip-top cap to the closed position and to separate from the second retention lug in response to deformation of the second elastic web relative to the top and outer walls of the body to allow movement of the flip-top cap away from the body toward the opened position.

19. A child-resistant closure comprising a body including a top wall formed to include a product-dispensing spout, an interior mount rim appended to an underside of the top wall and adapted to mate with a discharge outlet formed on a container, and an outer wall appended to the top wall and arranged to extend downwardly away from the top wall and to cooperate with the top wall to form an interior region receiving the interior mount rim therein, a flip-top cap including a movable lid formed to include an interior chamber and a first retention lug coupled to the lid to move therewith, a hinge coupled to the body and to the lid to support the flip-top cap for movement relative to the body from a closed position on the body covering the product-dispensing spout to an opened position away from the body uncovering the product-dispensing spout, wherein exterior surfaces of the top and outer walls cooperate to define an outwardly opening recessed first alcove associated with the first retention lug, the body further includes an elastic web located in the first alcove and an upstanding first cap-retainer latch coupled to the elastic web for movement therewith during deformation of the elastic web and the first cap-retainer latch is arranged to mate with the first retention lug in the interior chamber formed in the lid to retain the flip-top cap in the closed position on the body in response to movement of the flip-top cap to the closed position and to separate from the first retention lug in response to deformation of the elastic web relative to the top and outer walls of the body to allow movement of the flip-top cap away from the body toward the opened position, wherein the elastic web includes a deformable side panel coupled to a section of a perimeter edge of the outer wall of the body and to the first cap-retainer latch, wherein the deformable side panel includes a first panel section coupled to the outer wall, a second panel section located in spaced-apart relation to the first panel section and coupled to the outer wall, and a first latch-release pad arranged to interconnect the first and second panel sections and extend upwardly in a vertical direction toward the first cap-retainer latch, and wherein the section of the perimeter edge of the outer wall includes a first J-shaped border edge coupled to the first panel section and a second J-shaped border edge coupled to the second panel section.

20. A child-resistant closure comprising a body including a top wall formed to include a product-dispensing spout, an interior mount rim appended to an underside of the top wall and adapted to mate with a discharge outlet formed on a container, and an outer wall appended to the top wall and arranged to extend downwardly away from the top wall and to cooperate with the top wall to form an interior region receiving the interior mount rim therein, a flip-top cap including a movable lid formed to include an interior chamber and a first retention lug coupled to the lid to move therewith, a hinge coupled to the body and to the lid to support the flip-top cap for movement relative to the body from a closed position on the body covering the product-dispensing spout to an opened position away from the body uncovering the product-dispensing spout, wherein exterior surfaces of the top and outer walls cooperate to define an outwardly opening recessed first alcove associated with the first retention lug, the body further includes an elastic web located in the first alcove and an upstanding first cap-retainer latch coupled to the elastic web for movement therewith during deformation of the elastic web, and the first cap-retainer latch is arranged to mate with the first retention lug in the interior chamber formed in the lid to retain the flip-top cap in the closed position on the body in response to movement of the flip-top cap to the closed position and to separate from the first retention lug in response to deformation of the elastic web relative to the top and outer walls of the body, to allow movement of the flip-top cap away from the body toward the opened position, wherein the elastic web includes a deformable side panel coupled to a section of a perimeter edge of the outer wall of the body and to the first cap-retainer latch, wherein the deformable side panel includes a first panel section coupled to the outer wall, a second panel section located in spaced-apart relation to the first panel section and coupled to the outer wall, and a first latch-release pad arranged to interconnect the first and second panel sections and extend upwardly in a vertical direction toward the first cap-retainer latch, and wherein the first latch-release pad includes a first radially outwardly extending side wall coupled to the first panel section, a second radially outwardly extending side wall coupled to the second panel section, and a circumferentially extending exterior wall interconnecting the first and second radially outwardly extending side walls and interconnecting the outer wall and the first cap-retainer latch.

21. A child-resistant closure comprising a body including a top wall having a first thickness and formed to include a product-dispensing spout, an interior mount rim appended to an underside of the top wall and adapted to mate with a discharge outlet formed on a container, and an outer wall appended to the top wall and arranged to extend downwardly away from the top wall and to cooperate with the top wall to form an interior region receiving the interior mount rim therein, a flip-top cap including a movable lid formed to include an interior chamber and a first retention lug coupled to the lid to move therewith, a hinge coupled to the body and to the lid to support the flip-top cap for movement relative to the body from a closed position on the body covering the product-dispensing spout to an opened position away from the body uncovering the product-dispensing spout, wherein exterior surfaces of the top and outer walls cooperate to define an outwardly opening recessed first alcove associated with the first retention lug, the body further includes an elastic web located in the first alcove and an upstanding first cap-retainer latch coupled to the elastic web for movement therewith during deformation of the elastic web, and the first cap-retainer latch is arranged to mate with the first retention lug in the interior chamber formed in the lid to retain the flip-top cap in the closed position on the body in response to movement of the flip-top cap to the closed position and to separate from the first retention lug in response to deformation of the elastic web relative to the top and outer walls of the body to allow movement of the flip-top cap away from the body toward the opened position, and wherein the elastic web includes a deformable top panel coupled to a section of a perimeter edge of the top wall and to the first cap-retainer latch, the deformable top panel has a second thickness that is thinner than the first thickness of the top wall.

22. The closure of claim 21 wherein the first latch-release pad is configured to provide means for deforming the deformable top panel upon exposure to an inward pushing force applied by a user to an exterior portion of the first latch-release pad to cause movement of the first cap-retainer latch relative to the top wall of the body to disengage the first retention lug included in the flip-top cap when the flip-top cap is in the closed position so that the flip-top cap is free to be moved by the user away from the closed position toward the opened position.

23. A child-resistant closure comprising a body including a top wall formed to include a product-dispensing spout, an interior mount rim appended to an underside of the top wall and adapted to mate with a discharge outlet formed on a container, and an outer wall having a first thickness and appended to the top wall and arranged to extend downwardly away from the top wall and to cooperate with the top wall to form an interior region receiving the interior mount rim therein, a flip-top cap including a movable lid formed to include an interior chamber and a first retention lug coupled to the lid to move therewith, a hinge coupled to the body and to the lid to support the flip-top cap for movement relative to the body from a closed position on the body covering the product-dispensing spout to an opened position away from the body uncovering the product-dispensing spout, wherein exterior surfaces of the top and outer walls cooperate to define an outwardly opening, recessed first alcove associated with the first retention lug, the body further includes an elastic web located in the first alcove and an upstanding first cap-retainer latch coupled to the elastic web for movement therewith during deformation of the elastic web, and the first cap-retainer latch is arranged to mate with the first retention lug in the interior chamber formed in the lid to retain the flip-top cap in the closed position on the body in response to movement of the flip-top cap to the closed position and to separate from the first retention lug in response to deformation of the elastic web relative to the top and outer walls of the body to allow movement of the flip-top cap away from the body toward the opened position, wherein the elastic web includes a deformable side panel coupled to a section of a perimeter edge of the outer wall of the body and to the and to the first cap-retainer latch, the deformable side panel has a second thickness that is thinner than the first thickness of the outer wall, and wherein the elastic web includes a deformable top panel coupled to a section of a perimeter edge of the top wall, to the deformable side panel and to the first cap-retainer latch.

* * * * *